US005667085A

United States Patent [19]

Ogden et al.

[11] Patent Number: 5,667,085

[45] Date of Patent: Sep. 16, 1997

[54] CAP FOR A CONTAINER

[75] Inventors: Brian Leslie Ogden; Peter Albert Whiting, both of Dartford, Great Britain

[73] Assignee: Warner Lambert Co., Morris Plains, N.J.

[21] Appl. No.: 564,068

[22] PCT Filed: Jun. 14, 1994

[86] PCT No.: PCT/GB94/01277

§ 371 Date: Dec. 28, 1995

§ 102(e) Date: Dec. 28, 1995

[87] PCT Pub. No.: WO94/29185

PCT Pub. Date: Dec. 22, 1994

[30] Foreign Application Priority Data

Jun. 15, 1993 [GB] United Kingdom ..... 9312275.2

[51] Int. Cl.[6] ..... B65D 50/04

[52] U.S. Cl. ..... 215/220; 215/253

[58] Field of Search ..... 215/219, 220, 215/223, 250, 253

[56] References Cited

U.S. PATENT DOCUMENTS

| | | | |
|---|---|---|---|
| 4,335,172 | 6/1982 | Sato . | |
| 4,527,701 | 7/1985 | Schaubeck | 215/220 |
| 4,669,620 | 6/1987 | Coifman | 215/220 |
| 4,724,972 | 2/1988 | Marcus | 215/223 |
| 4,801,028 | 1/1989 | Puresevic et al. | 215/220 |
| 4,928,837 | 5/1990 | Curiel | 215/220 |
| 5,013,088 | 5/1991 | Marin . | |
| 5,054,633 | 10/1991 | Reijenga | 215/220 |

FOREIGN PATENT DOCUMENTS

| | | | |
|---|---|---|---|
| 8803179 | 7/1990 | Netherlands | 215/220 |
| WO94/29185 | 12/1994 | WIPO . | |

*Primary Examiner*—Stephen Cronin
*Attorney, Agent, or Firm*—Nixon & Vanderhye

[57] ABSTRACT

A cap for a container having a screw threaded opening comprising an inner part (1) in the form of a screw threaded cap, an outer part (2), biased therefrom in a first, locking position, by means of resilient biasing means (3) located between the inner and outer parts, a projection (4) located on the inner part (1) and adapted to be received in an aperture (8) formed in the outer part (2), and a tamper-evident member (6) secured on the outer top surface of the outer part (2) such that it substantially covers the aperture (8), wherein on first removing the cap from the container the outer part (2) is moved into a second, unlocking position, against the biasing, the projection (4) being received in the aperture (8), and projecting therebeyond, such that at least a portion of the tamper-evident member (6) is ruptured.

8 Claims, 2 Drawing Sheets

CAP FOR A CONTAINER

Figure 1:
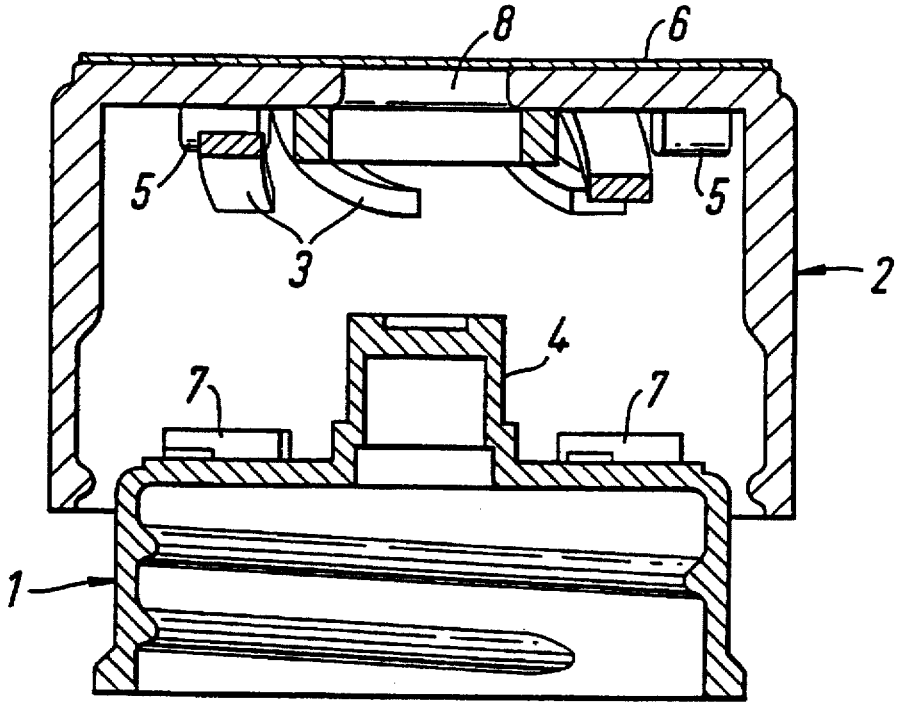

This invention relates to a tamper-evident cap for a container. In particular it relates to a tamper-evident cap for use with a pharmaceutical container.

It is now common practice in both the food and pharmaceutical industries to include tamper-evident features in their packaging. The aim is to eliminate, as far as possible, tampering with and/or adulteration of the contents of a particular container.

Tamper-evident features are particularly used on containers, e.g. bottles, for liquid products and are often associated with the cap used thereon.

One of the commonest forms of tamper-evident feature consists of a continuous strip, frangibly connected to the cap. When the cap is removed for the first time the frangible portions break, thus separating the strip from the rest of the cap. This particular type of feature is most commonly used with drinks containers, generally bottles, produced by the food industry.

There are however problems associated with this type of feature. Firstly it is often not immediately evident that a container has been opened. Quite close, detailed, examination is often required to determine whether the frangible portions have been broken. Secondly the cap must be moulded with the tear off strip. The cap must then be "snapped" onto the bottle with the strip being retained by a ridge or lip such that as the cap is unscrewed the strip is forced against the ridge or lip and the frangible portions break. However the tolerances are quite small and it is often possible to remove the cap with the strip intact, which of course allows tampering with the contents.

Pharmaceutical containers also sometimes include this type of feature. However pharmaceutical containers often have child resistant caps. A particularly common form of cap used consists of two parts which can rotate relative to each other. The outer cap is also generally axially displaceable relative to the inner cap and in order to unscrew the cap it is necessary to push down the outer cap such that it interlocks with the inner cap and allows unscrewing of the cap from the container. The use of a frangible strip is not particularly suited to such caps.

UK 2142612, UK 2167050 and EP-A-0182519 all describe child resistant closures which incorporate a tamper-evident feature. This generally consists of a portion which is frangibly connected to the outer cap such that when the outer cap is depressed for the first time relative to the inner cap, means on the inner cap cause the frangible portions to break. The tamper-evident portion is thus either removed completely, or more usually, "pops up" while still being partly connected to the outer cap. This provides a much more immediately obvious visual indication of opening.

However, once again there are problems associated with this type of cap. Firstly, given that it is recognised that children may try to open the container, there is a possibility that the tamper indicating portion may be broken off. In such a case a child may swallow the plastic portion, which is of course potentially dangerous. Secondly, accurate moulding of the cap requires quite high tolerances. The outer cap must also be moulded as a single piece, with the tamper-evident portion connected via frangible webs. This is critical since if the webs are too thick for instance then they may not break as required.

There is therefore a need for a cap, incorporating a tamper-evident feature which overcomes the above-noted disadvantages.

A cap for a container having a screw threaded opening comprising an inner part in the form of a screw threaded cap, an outer part, biased therefrom in a first, locking position, by means of resilient biasing means located between the inner and outer parts, a projection located on the inner part and adapted to be received in an aperture formed in the outer part, the cap also comprising a tamper-evident member secured to the outer top surface of the outer part such that it substantially covers the aperture, wherein on first removing the cap from the container the outer part is moved into a second, unlocking position, against the biasing, the projection being received in the aperture, and projecting there beyond, such that at least a portion of the tamper-evident member is raptured, characterised in that the tamper-evident member is a paper film or label secured on said outer top surface.

The tamper-evident member is preferably a paper film or label which can simply be glued over the top of the outer part such that it at least substantially covers the aperture.

Preferably the area of the tamper-evident member aligned with, and covering, the aperture is weakened in some way, generally by a pattern of perforations, to facilitate rupturing by the projection.

In a particularly preferred embodiment of the invention, the pattern of perforations consists of a plurality (generally at least 4) of "S" shaped perforations radiating outwardly from a central point. Such a pattern provides efficient rupturing and is also particularly difficult to reassemble in any attempt to disguise opening.

The cap provided herein avoids the disadvantages noted above. Once the two part caps have been made, the tamper-evident member can simply be secured on the top surface of the outer cap. The tolerances required are much lower. The rupturing of the member on first opening provides a clear, effective, visual sign of opening. Also, once ruptured, the member cannot be reassembled in any way to disguise the fact that opening has occurred.

In addition, the tamper evident member can be provided with a number of radial slits, for instance four, which prevent removal of the label without tearing. This will also help prevent tampering.

In further embodiments the invention provides a tamper-evident member for use with a container cap and a container equipped with a cap of the invention, preferably a pharmaceutical container.

Figure 2:
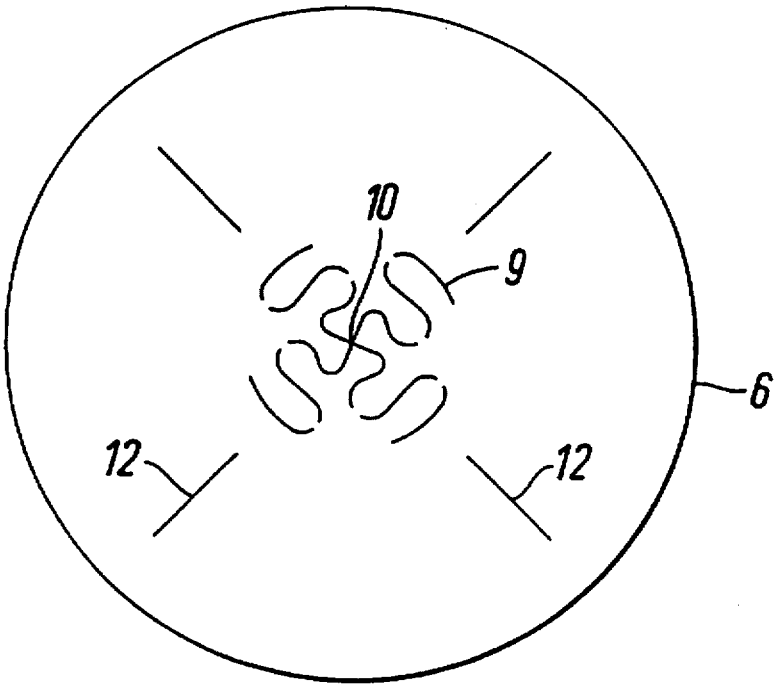
Figure 3:
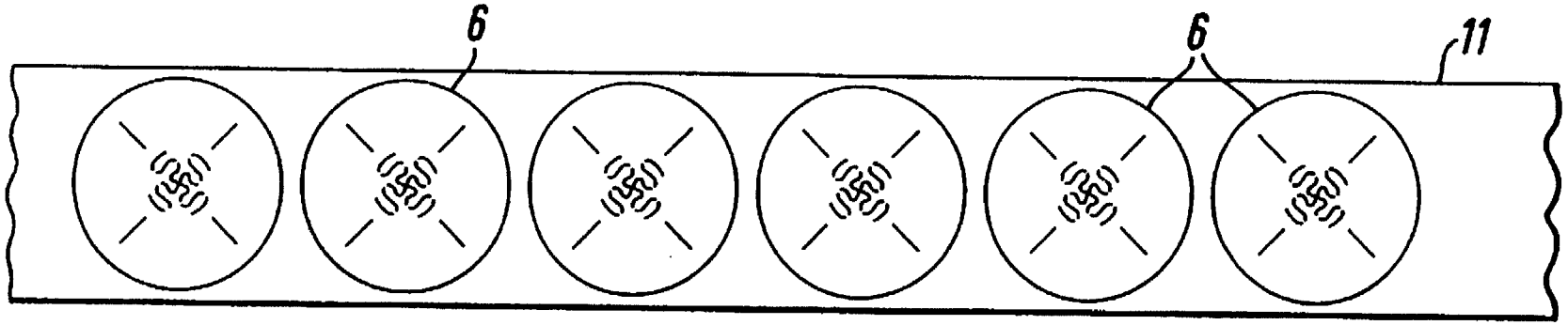

The invention will now be described by way of example only with reference to the accompanying drawings in which;

FIG. 1 is a cross-sectional view of a preferred cap of the invention, separated into inner and outer parts FIG. 2 is a plan view from above of a preferred tamper evident member; and FIG. 3 shows a strip of the preferred tamper-evident members ready for attachment to container caps.

In FIG. 1, the cap can be seen to comprise an inner part (1), which is screw threaded and an outer part (2). Resilient biasing means (3) depend from the inner top surface of the outer part (2). A projection (4) extends upwardly from the outer top surface of the inner part (1) and upon depression of the outer part (2) relative to the inner part (1) will project into and beyond the aperture (8) rupturing that part of the tamper-evident member (6) which covers the aperture (8). Engagement means (5,7) serve to lock the inner and outer (1) parts together upon depression of the outer part (2) relative to the inner part (1).

FIG. 2 shows a plan view of a tamper-evident member which can be secured to the outer top surface of the cap. The series of "S" shaped perforations (9) can clearly be seen radiating out from the centre (10) of the member (6). Four radial slits (12) are shown, which will prevent removal of the member from a cap without tearing.

FIG. 3 shows a series of tamper-evident members (6) produced as a strip (11). A member (6) can simply be removed and secured to a cap during manufacture.

As shown in the drawings the aperture, and corresponding projection are both located at the centre of the cap. However the skilled man will appreciate that the invention will function just as well if the aperture and projection were offset, for instance.

We claim:

1. A cap for a container having a screw threaded opening comprising an inner part in the form of a screw threaded cap, an outer part, biased from the inner part in a first, locking position, by resilient biasing means located between the inner and outer parts, a projection located on the inner part and adapted to be received in an aperture formed in the outer part, the cap also comprising a tamper-evident member secured to the outer top surface of the outer part and having a portion that substantially covers the aperture, wherein on first removing the cap from the container the outer part is moved into a second, unlocking position, against the resilient biasing means, the projection being received in the aperture and projecting therebeyond, such that at least a portion of the tamper-evident member is ruptured wherein the tamper-evident member is selected from the group consisting of a paper film and label secured on said outer top surface.

2. A cap as claimed in claim 1 wherein the paper film or label is adhered to the outer top surface by glue.

3. A cap as claimed in claim 1 or claim 2 wherein said portion of the tamper-evident member covering the aperture is weakened with respect to that portion not covering the aperture.

4. A cap as claimed in claim 3 wherein the weakening consists of a pattern of inter-locking perforations.

5. A cap as claimed in claim 4 wherein the pattern consists of a plurality of "S" shaped perforations.

6. A cap as claimed in claim 1 or claim 2 wherein the tamper-evident member has a plurality of radial slits.

7. A container equipped with a cap, said cap having a screw threaded opening comprising an inner part in the form of a screw threaded cap, an outer part, biased from the inner part in a first, locking position, by resilient biasing means located between the inner and outer parts, a projection located on the inner part and adapted to be received in an aperture formed in the outer part, the cap also comprising a tamper-evident member secured to the outer top surface of the outer part and having a portion that substantially covers the aperture, wherein on first removing the cap from the container the outer part is moved into a second, unlocking position, against the resilient biasing means, the projection being received in the aperture and projecting therebeyond, such that at least a portion of the tamper-evident member is ruptured wherein the tamper-evident member is selected from the group consisting of a paper film and label secured on said outer top surface said portion of the tamper evident member which overlies said aperture consisting of a pattern of interlocking perforations, and a plurality of radial slits extending from said pattern of perforations towards the periphery of the tamper-evident member.

8. A container as claimed in claim 7 which is a pharmaceutical container.

* * * * *